US008938816B2

(12) United States Patent
Söderström

(10) Patent No.: US 8,938,816 B2
(45) Date of Patent: Jan. 27, 2015

(54) FEMALE PANTS

(75) Inventor: Peter Söderström, Stockholm (SE)

(73) Assignee: Friga LLC, New York, NY (US)

( * ) Notice: Subject to any disclaimer, the term of this patent is extended or adjusted under 35 U.S.C. 154(b) by 822 days.

(21) Appl. No.: 12/527,837

(22) PCT Filed: Feb. 22, 2008

(86) PCT No.: PCT/SE2008/000152

§ 371 (c)(1),
(2), (4) Date: Aug. 21, 2009

(87) PCT Pub. No.: WO2008/103114

PCT Pub. Date: Aug. 28, 2008

(65) Prior Publication Data

US 2010/0017945 A1 Jan. 28, 2010

(30) Foreign Application Priority Data

Feb. 22, 2007 (SE) ..... 0700499

(51) Int. Cl.
*A41B 9/04* (2006.01)
*A41B 9/00* (2006.01)
*A41D 27/28* (2006.01)

(52) U.S. Cl.
CPC . *A41B 9/04* (2013.01); *A41B 9/004* (2013.01); *A41D 27/28* (2013.01); *A41B 2400/20* (2013.01)
USPC ..... 2/406

(58) Field of Classification Search
USPC ..... 2/406, 407, 408
See application file for complete search history.

(56) References Cited

U.S. PATENT DOCUMENTS 4,009,495 A * 3/1977 Faust ..... 2/406
4,229,835 A * 10/1980 Shaw ..... 2/406
4,244,059 A * 1/1981 Pflaumer ..... 2/400
4,325,148 A * 4/1982 Livernois ..... 2/465

(Continued)

FOREIGN PATENT DOCUMENTS

FR 2 131 852 A 11/1972
GB 2 085 710 A 5/1982

*Primary Examiner* — Amber Anderson
(74) *Attorney, Agent, or Firm* — Dickstein Shapiro LLP

(57) ABSTRACT

The invention refers to a pair of female pants intended to be used preferably by sportsmen and by other active persons and comprising a waist portion (2) connected to back and front portions (3,4), which at the crotch (5) of the wearer are interconnected or merge into each other into a crotch portion (6), which comprises at its inside an air permeable and moisture transporting material layer (7), which attends to that the lower abdomen of the wearer is ventilated. The material layer (7), having a width mainly corresponding to the crotch width of the pants (1) and a length extending a predetermined distance forwards and backwards from the middle of the crotch portion (6), also in a compressed condition maintains an air slot, which makes it possible that air can be circulated over the crotch of a wearer and as well both in a deep direction and in a longitudinal direction through the material layer (7) at the same time as a tempered zone by both air exchanging and the structure of the material layer in an active way drains the crotch portion (6) by that said structure of the material layer (7) consists of a direct from the crotch portion (6) or indirect from a supporting layer (11, 12, 12', 12") fixed to the crotch portion (6) protruding through the same extending air channels (14,21) with surrounding fiber material (7', 7") or a flexible thread- and/or strip-formed material (8).

5 Claims, 5 Drawing Sheets

(56) References Cited

U.S. PATENT DOCUMENTS 6,209,143 B1 4/2001 Hancock
6,393,621 B1 * 5/2002 Redwine et al. ..... 2/406
6,401,250 B1 6/2002 McNabb
6,807,685 B1 * 10/2004 Hasegawa et al. ..... 2/406

* cited by examiner

FEMALE PANTS

The present invention refers to a pair of female pants intended to be used preferably by sportsmen and by other active persons and comprising a waist portion connected to back and front portions, which at the crotch of the wearer are interconnected or merge into each other into a crotch portion, said crotch portion comprises at its inside an air permeable and moisture transporting material layer, which attends to that the lower abdomen of the wearer is ventilated.

Female pants used today and which can be found on the market in the form of underwears or sport trousers in many cases are provided with an inner trouser or a lining, which can be perforated in providing a certain air permeability. Several women are usually warm/moisture sensitive in the crotch especially owing to a very closed, warm and wet area. Using the tight cloths of today this area becomes much more air tight/wet and because of that a growing place for sponge, irritations of different nature and not the least for daily comfort. The drawback with the mentioned known trousers, which are adapted to be used within sport activities, is that they do not effectively provide for a sufficiently air exchange in the crotch area.

An object of the present invention is to provide a new type of female pants, which eliminate those problems mentioned above.

Thanks to the invention a pair of female pants has been provided, which in an excellent way fulfils its purposes at the same time as it is both easy and not expensive to manufacture. The idea of the function of the pants according to the invention is that at the same time as fresh air is supplied perspiration and moisture are transported by the material layer according to the invention both in a depth direction and horizontally in the material layer out to the adjacent cloth layer. This cannot take place via customary underwear, when the cloths and the crotch of the woman constitute only one layer and when i.a. the air exchange is stopped and perspiration is established immediately, which besides stays in the crotch material of the trousers/pants. When the pants according to the present invention is used perspiration and moisture does not remain at the same time as fresh air is supplied.

BRIEF DESCRIPTION OF DRAWINGS

The invention is described closer below with help of some preferred embodiment examples with reference to the accompanying drawings, in which.

DETAILED DESCRIPTION

Figure 1:
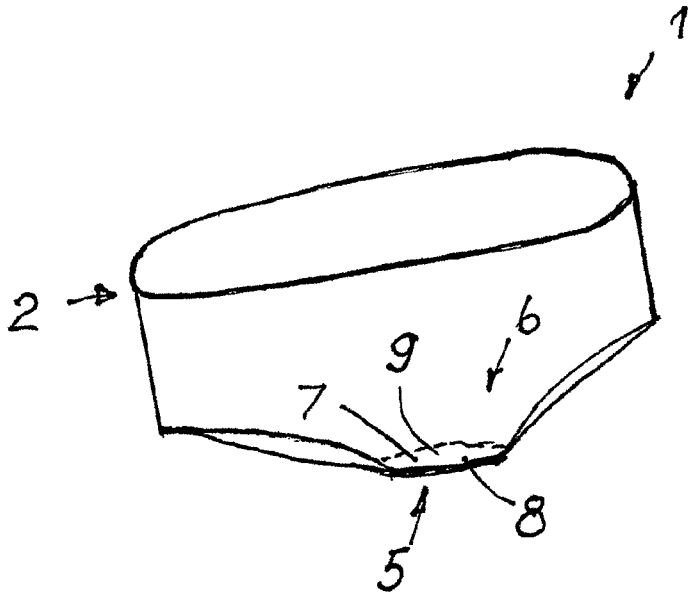
FIG. 1 shows a schematic perspective view of a pair of female pants according to the invention.
Figure 2:
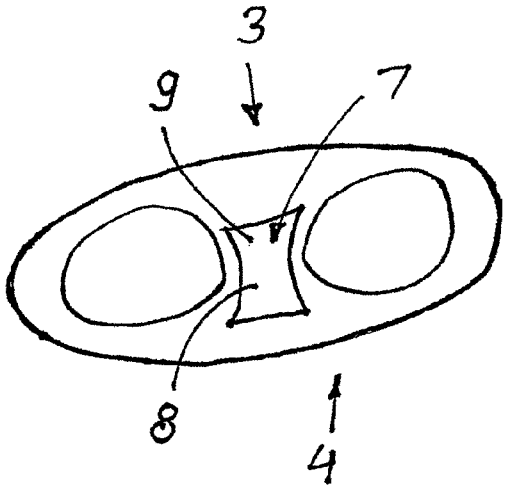
FIG. 2 shows a schematic perspective view of the pants illustrated in FIG. 1, viewed from above.

As can be seen from the figures here is illustrated a number of embodiment examples of a pair of female pants 1 according to the present invention. The pair of female pants 1, which especially is adapted to be used by sportsmen and by other active persons comprises a waist portion 2 connected to back and front portions 3 and 4. These merge into each other or are interconnected at the crotch 5 of the wearer in a crotch portion 6. The crotch portion 6 comprises on its inside a direct or indirect via a support layer against the same fixed air permeable, not absorbing material layer 7 in the form of a lining 9, which also in a compressed condition maintains an air slot, which makes it possible that air can be circulated both in a longitudinal and a deep direction through the material layer 7 over and along the crotch of a wearer at the same time as a tempered zone through both air exchanging and the structure of the material layer in an active way drains the crotch portion 6.

Figure 3:
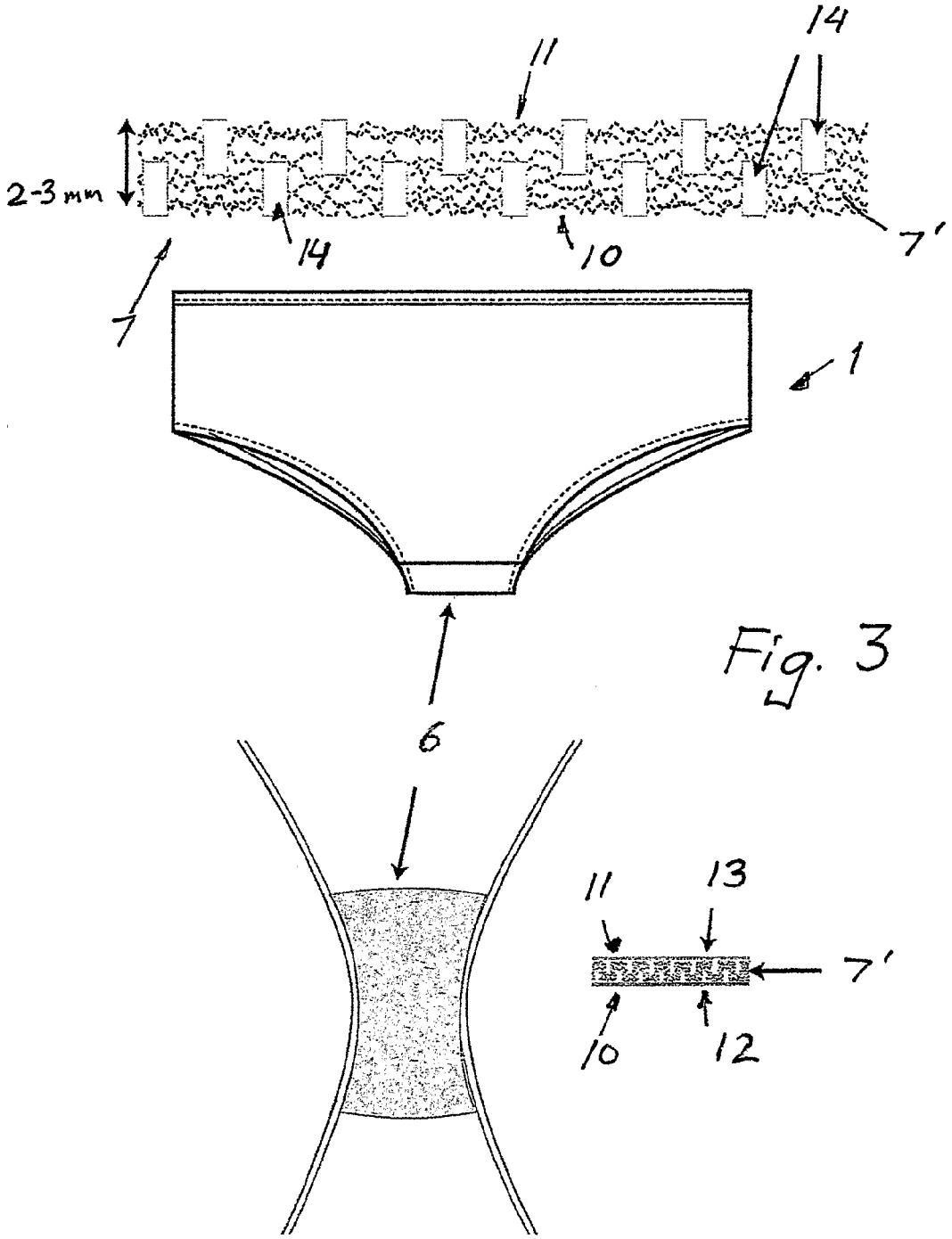
FIG. 3 shows a pair of pants having an air permeable material layer according to a first embodiment example, which consists of a fibre material having air channels, which extend alternately towards the middle of the material layer.

In the embodiment example illustrated in FIG. 3 the structure of the material layer 7 consists of a fibre material 7', which on its inside 10 is covered by support layer 12 of a cloth like material and which whenever applicable over whole or parts of its outside 11 also this is covered of a cloth like material 13 and which comprises over mainly the total width of the same a number of air channels 14 alternating from the inside and outside in a direction towards and approximately up to the middle of the fibre material 7' extending air channels 14. Hereby a transporting material is obtained, which allows a very advantageous transport of body fluids through the material layer 7 with a quick evaporation as a consequence.

Figure 4:
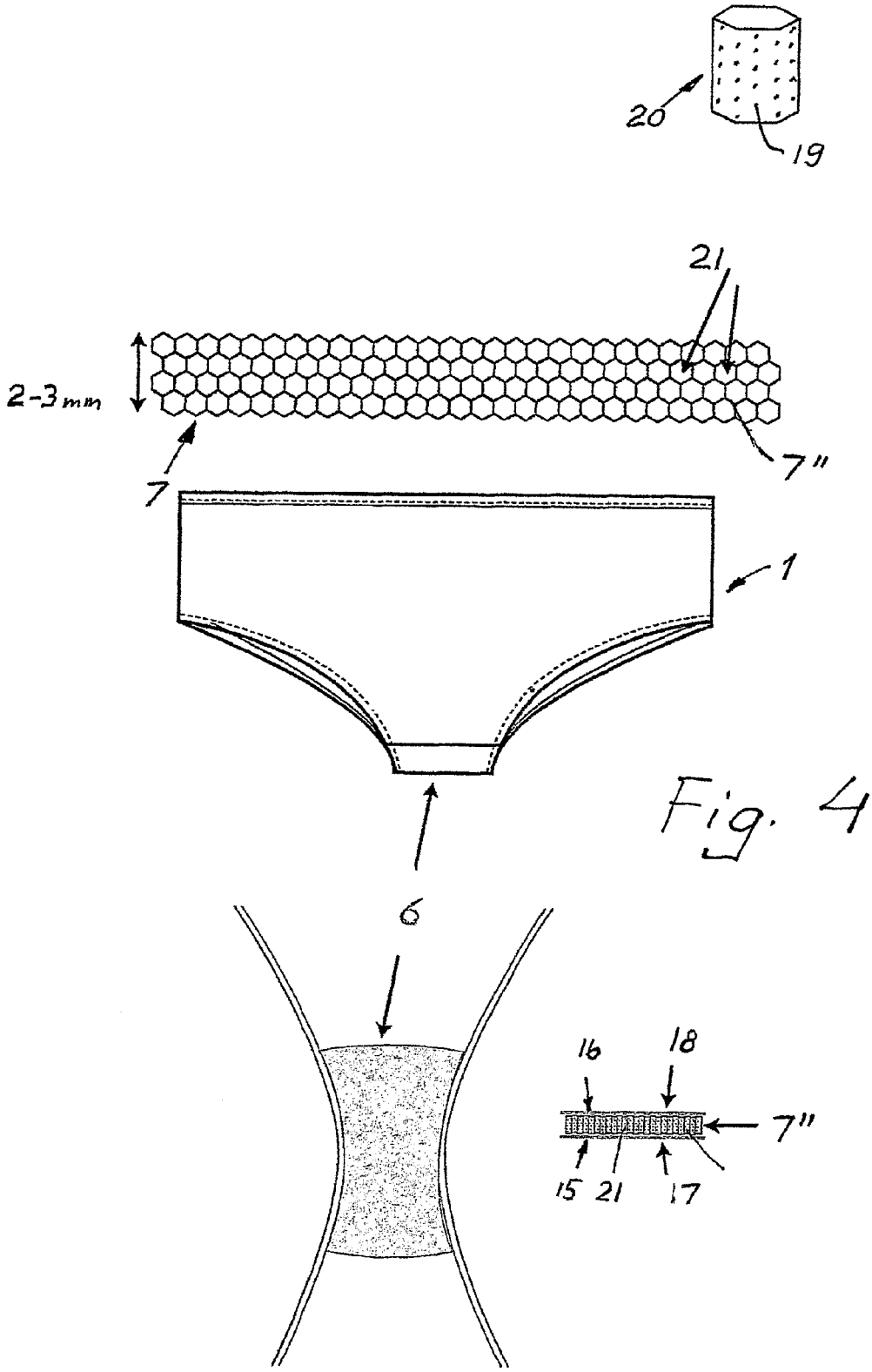
FIG. 4 shows a pair of pants having a second embodiment example of material layer, which here consists of a fibre material perforated by micro openings.

In the embodiment example of the pair of pants 1 illustrated in FIG. 4 the design of the material layer 7 consists of a fibre material 7", which on its inside 15 is covered by a supporting layer 17 of a cloth like material and which whenever applicable over the whole or parts of its outside 16 also this is covered by a cloth like material 18 and which comprises a lot of near each other from the inside 15 to the outside 16 extending and such as air channels 21 serving fibres 20 perforated with micro openings 19. Also this embodiment example causes a fast transport and evaporation of produced body fluids.

By that the pair of pants 1 comprises an air permeable not absorbing material layer 7 fixed in the crotch portion 6, which comprises a non absorbing material layer 7 fixed to the crotch portion 6, which also in its compressed condition maintains an air slot or rather a lot of air slots both in a longitudinal direction and in a depth direction through the material layer 7, it has been made possible that air can circulate over the crotch of a wearer, so that a tempered zone is maintained by both an air exchange and drainage in an active way. In this respect a very active evaporation is obtained of body fluids and also during a compression a slot or a layer, which admits a plentiful air exchange, is remained at the same time as fluids and moisture are allowed to pass out from the pair of pants without that the air exchange itself is prevented.

Figure 5:
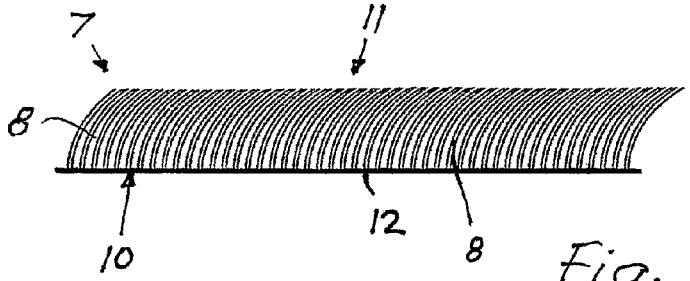
FIG. 5 shows a partial cross section view of a third embodiment example of an air transmitting material layer.

The material layer 7 according to the embodiment example illustrated in FIG. 5 consists of an elastic thread- or strip-formed material 8, which on its inside 10 is covered by a supporting layer 12 of a cloth like material and which whenever applicable over the whole or parts of its outside 11 is covered by a cloth or cloth like material and where said thread- or strip-formed material extends from the inside 10 to the outside 11. The material layer 7 has a coil formed or bow formed extension, which is a help to its elasticity and which in this way can maintain said air permeability also in a compressed condition.

Figure 6:
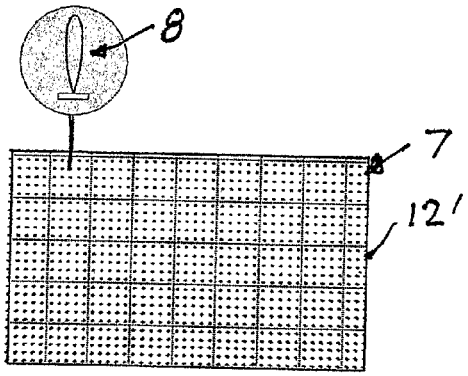
FIG. 6 shows a partial cross section view of a fourth embodiment example of an air transmitting material layer according to the invention.
Figure 7:
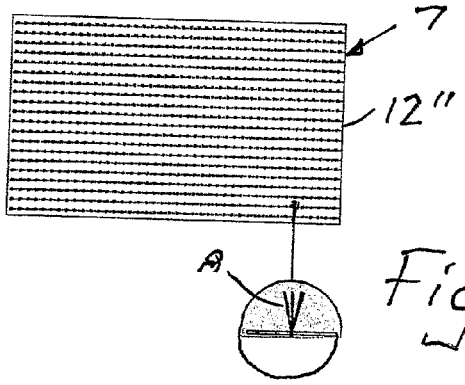
FIG. 7 shows a partial cross section view of a fifth embodiment example of an air transmitting material layer according to the invention.

In FIG. 6 a material layer 7 is illustrated, which consists of threads or strips 8 of fibre-, plastic- or synthetic material. Here the threads or strips 8 have the form of terry loops and which protrude from a supporting layer 12' and in FIG. 7 the threads or strips 8 have the form of one half of a sheaf, where the strips or the threads 8 converge from their fixation directly in the crotch portion or indirect via a supporting layer 12".

The material layer 7 has in the illustrated preferred embodiment examples a thickness in the crotch portion 6, which in its compressed condition is not below about 1 mm and in its unloaded condition has a thickness of about 2-10 mm. Furthermore the air permeable material layer 7 here has a width, which mainly corresponds to the crotch width of the pair of pants 1 and a length, which extends a predetermined length forwards and backwards from the middle of the crotch portion 6.

Figure 8:
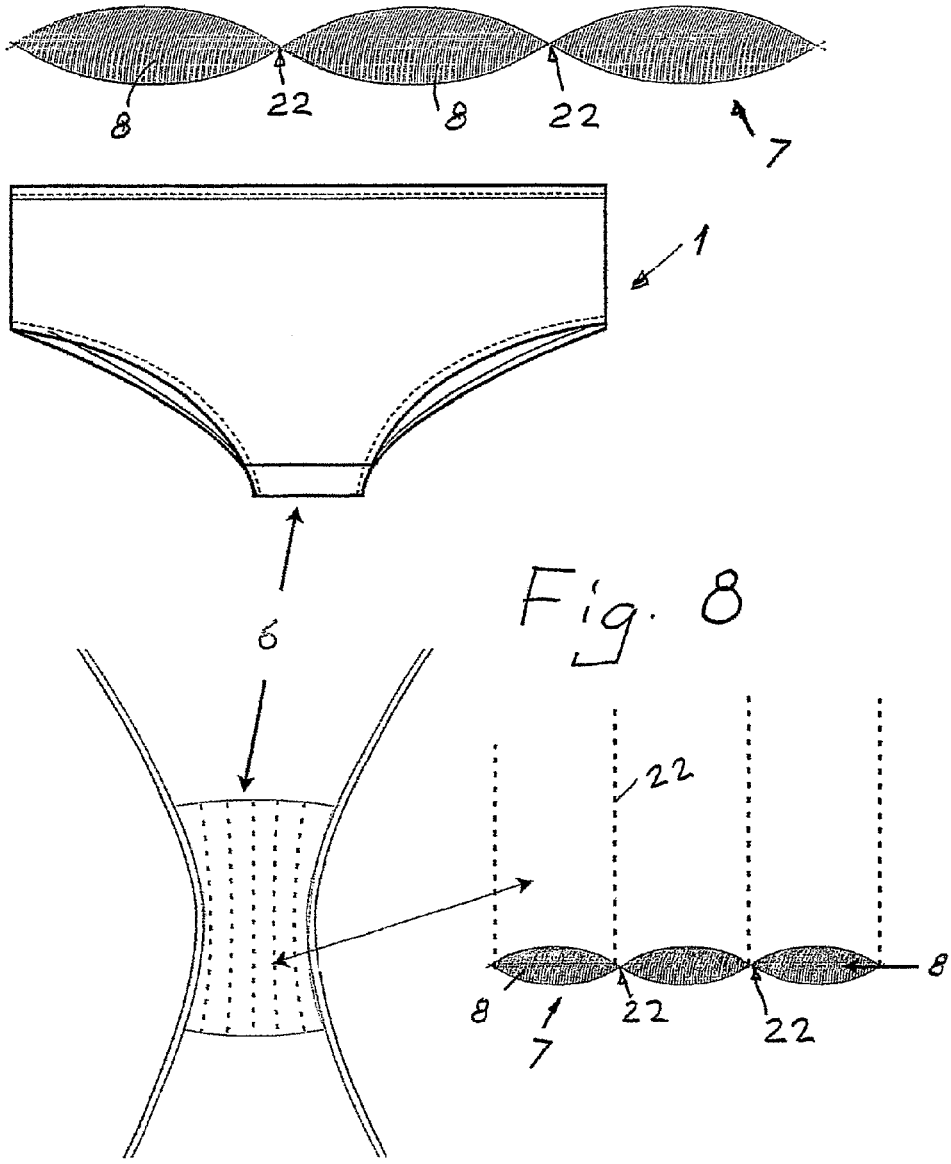
FIG. 8 shows a partial cross section view of a sixth embodiment example of an air transmitting material layer according to the invention.

In providing of a bigger flexibility of the material layer 7 it can, as is closer illustrated in FIG. 8, over its width or longitudinal direction be fastened together by elongated seams 22, whereby an increased mobility and flexibility can be provided by the material layer 7, in that case this should be desirable in certain connections. By these seams 22 a tightening up by the material layer 7 is provided, which serves like pivot means or bending places in the material layer 7 and which causes further mobility and flexibility and comfort.

The invention claimed is:

1. A pair of female pants for use by an active person, comprising:

front and back portions;

a waist portion connected to the front and back portions;

a crotch portion connected to the front and back portions, wherein the crotch portion includes an air permeable and moisture-transporting material layer for providing ventilation, wherein the air permeable and moisture-transporting material layer includes non-absorbent material, wherein the non-absorbent material has a width corresponding to a crotch width of the pair of pants and a length extending forward and backward from a middle portion of the crotch portion, wherein the non-absorbent material is compressible from a non-compressed condition to a compressed condition, wherein, in the compressed condition, the non-absorbent material has air channels that extend in a plane of the width and length of the non-absorbent material and in a direction that is perpendicular to the plane of the width and length of the non-absorbent material, and wherein, in the compressed condition, the air channels provide air circulation through the air permeable and moisture-transporting material layer and actively drain moisture from the crotch portion; and a flexible supporting layer that covers and is fixed to the crotch portion; and wherein the non-absorbent material includes a fiber material, and wherein the flexible supporting layer includes a cloth material, and wherein the air channels alternate in a direction toward and approximately up to a middle of the fiber material;

wherein the pair of female pants further comprises a cloth-like material covering, and wherein the non-absorbent material, including the fiber material and the air channels, is located between the cloth material of the flexible supporting layer and the cloth-like material covering;

wherein the non-absorbent material, in the non-compressed condition, has a thickness of about 2-10 mm in a depth direction, which is perpendicular to the plane of the width and length of the non-absorbent material;

wherein the air channels include first and second air channels, wherein the first air channels have first and second ends, the second air channels have first and second ends, the first air channels extend in the depth direction from the cloth material of the flexible supporting layer, approximately to the middle of the fiber material, but not to the cloth-like material cover, such that the fiber material is located between the second ends of the first air channels and the cloth-like material cover;

wherein the second air channels extend in the depth direction from the cloth-like material cover toward the cloth material of the flexible supporting layer, approximately to the middle of the fiber material, but not to the cloth material of the flexible supporting layer, such that the fiber material is located between the second ends of the second air channels and the cloth material of the flexible supporting layer; and wherein the second air channels are alternatingly located between the first air channels, and wherein the fiber material is located between the first air channels and the second air channels.

2. A pair of female pants for use by an active person, comprising:

front and back portions;

a waist portion connected to the front and back portions;

a crotch portion connected to the front and back portions, wherein the crotch portion includes an air permeable and moisture-transporting material layer for providing ventilation, wherein the air permeable and moisture-transporting material layer includes non-absorbent material, wherein the non-absorbent material has a width corresponding to a crotch width of the pair of pants and a length extending forward and backward from a middle portion of the crotch portion, wherein the non-absorbent material is compressible from a non-compressed condition to a compressed condition, wherein, in the compressed condition, the non-absorbent material has air channels that extend in a plane of the width and length of the non-absorbent material and in a direction that is perpendicular to the plane of the width and length of the non-absorbent material, and wherein, in the compressed condition, the air channels provide air circulation through the air permeable and moisture-transporting material layer and actively drain moisture from the crotch portion; and a flexible supporting layer that covers and is fixed to the crotch portion; and wherein the non-absorbent material includes a fiber material, and wherein the flexible supporting layer includes a cloth material, and wherein the fiber material includes fibers that are perforated with micro openings, and wherein the air channels which provide the air circulation through the air permeable and moisture-transporting material layer, and which actively drain moisture from the crotch portion, are formed by the fibers that are provided with the micro openings.

3. A pair of female pants for use by an active person, comprising:

front and back portions;

a waist portion connected to the front and back portions;

a crotch portion connected to the front and back portions, wherein the crotch portion includes an air permeable and moisture-transporting material layer for providing ventilation, wherein the air permeable and moisture-transporting material layer includes non-absorbent material, wherein the non-absorbent material has a width corresponding to a crotch width of the pair of pants and a length extending forward and backward from a middle portion of the crotch portion, wherein the non-absorbent material is compressible from a non-compressed condition to a compressed condition, wherein, in the compressed condition, the non-absorbent material has air channels that extend in a plane of the width and length of the non-absorbent material and in a direction that is perpendicular to the plane of the width and length of the non-absorbent material, and wherein, in the compressed condition, the air channels provide air circulation through the air permeable and moisture-transporting material layer and actively drain moisture from the crotch portion; and a flexible supporting layer that covers the whole crotch portion and is fixed to the crotch portion; and wherein the non-absorbent material, in the compressed condition, has a thickness of not less than about 1 mm in a depth direction, which is perpendicular to the plane of the width and length of the non-absorbent material;

wherein the non-absorbent material includes elongated elastic material, and wherein the flexible supporting layer includes a cloth material, and wherein the elongated elastic material extends in the direction that is perpendicular to the plane of the width and length of the non-absorbent material;

wherein the non-absorbent material, in the non-compressed condition, has a thickness of about 2-10 mm in the depth direction; and wherein the elongated elastic material includes elongated elements which protrude from the cloth material of the flexible supporting layer and are each elongated in the depth direction when the non-absorbent material is in the non-compressed condition, wherein the depth direction is perpendicular to the plane of the width and length of the non-absorbent material.

4. A pair of female pants according to claim 3, wherein the elongated elements are selected from the group consisting of fiber, plastic and synthetic material.

5. A pair of female pants according to claim 4, wherein the air permeable and moisture-transporting material layer is woven together to provide an elongated flexible layer which is fastened together in orthogonal directions by elongated seams.

* * * * *